US008331847B2

(12) United States Patent
Matsushita et al.

(10) Patent No.: US 8,331,847 B2
(45) Date of Patent: Dec. 11, 2012

(54) BOOKBINDING SYSTEM, BOOKBINDING METHOD, AND RECORDING MEDIUM STORING BOOKBINDING PROGRAM

(75) Inventors: Shingo Matsushita, Tokyo (JP); Junichi Iida, Kawasaki (JP); Hiroki Okada, Yokohama (JP); Takeshi Sasaki, Tokyo (JP); Takeshi Akai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 443 days.

(21) Appl. No.: 12/385,485

(22) Filed: Apr. 9, 2009

(65) Prior Publication Data

US 2009/0257846 A1 Oct. 15, 2009

(30) Foreign Application Priority Data

Apr. 9, 2008 (JP) ..... 2008-101484

(51) Int. Cl.
*G03G 15/00* (2006.01)

(52) U.S. Cl. ..... 399/408; 399/407

(58) Field of Classification Search ..... 399/408, 399/407; 412/38, 40, 41
See application file for complete search history.

(56) References Cited

U.S. PATENT DOCUMENTS

| | | | | |
|---|---|---|---|---|
| 7,416,177 | B2 | 8/2008 | Suzuki et al. | |
| 2003/0156872 | A1* | 8/2003 | Hirai | 399/407 |
| 2005/0265809 | A1* | 12/2005 | Lemens et al. | 412/33 |
| 2006/0055100 | A1 | 3/2006 | Suzuki et al. | |
| 2007/0056423 | A1 | 3/2007 | Yamada et al. | |
| 2007/0065203 | A1* | 3/2007 | Kikuchi | 399/407 |
| 2008/0008491 | A1* | 1/2008 | Tao et al. | 399/82 |
| 2008/0075560 | A1* | 3/2008 | Kurabayashi et al. | 412/38 |
| 2008/0179809 | A1 | 7/2008 | Kikkawa et al. | |
| 2008/0284092 | A1 | 11/2008 | Suzuki et al. | |

FOREIGN PATENT DOCUMENTS

| | | |
|---|---|---|
| JP | 63-231988 | 9/1988 |
| JP | 07-069525 | 3/1995 |
| JP | 09-240915 | 9/1997 |
| JP | 11-301919 | 11/1999 |
| JP | 2002-128385 | 5/2002 |
| JP | 2003-054154 | 2/2003 |

(Continued)

OTHER PUBLICATIONS

Office Action for corresponding Japanese Application No. 2008-101484 issued Aug. 28, 2012.

*Primary Examiner* — Judy Nguyen
*Assistant Examiner* — Blake A Tankersley
(74) *Attorney, Agent, or Firm* — Harness, Dickey & Pierce

(57) ABSTRACT

A bookbinding system to bind together a batch of sheets transported from an image forming apparatus. The bookbinding system includes a punch unit to form a predetermined number of ring holes in a predetermined portion along a side of the sheets to be bound one by one or in a batch, a ring-binding unit disposed downstream from the punch unit in a direction in which the sheet is transported to insert rings of a ring member into the ring holes formed on the batch of sheets by the punch unit, a ring detector disposed at a portion where the ring member is set to detect a type of the ring member, and a determination unit to determine whether or not an ring-binding operation is executable based on a type of the ring member and a size of the sheets to be bound together.

19 Claims, 8 Drawing Sheets

FOREIGN PATENT DOCUMENTS

| | | |
|---|---|---|
| JP | 2006-151592 | 6/2006 |
| JP | 2007-030319 | 2/2007 |
| JP | 2007-031068 | 2/2007 |
| JP | 2007-055179 | 3/2007 |
| JP | 2007-055180 | 3/2007 |
| JP | 2007-326255 | 12/2007 |

* cited by examiner

BOOKBINDING SYSTEM, BOOKBINDING METHOD, AND RECORDING MEDIUM STORING BOOKBINDING PROGRAM

CROSS-REFERENCE TO RELATED APPLICATIONS

This patent specification claims priority from Japanese Patent Application No. 2008-101484, filed on Apr. 9, 2008 in the Japan Patent Office, the entire contents of which are hereby incorporated by reference herein.

BACKGROUND OF THE INVENTION

1. Field of the Invention

The present invention generally relates to a bookbinding device connected to an image forming apparatus such as a copier, a printer, a facsimile machine, and a digital multifunction machine including at least two of those functions, a bookbinding method, and a recording medium including a bookbinding program.

2. Discussion of the Background

A finisher serially connected to an image forming apparatus such as a copier, a printer, a facsimile machine, and a digital multifunction machine including at least two of those functions can automatically perform post-processing, such as aligning, sorting, stapling, punching and/or bookbinding of sheets of recording media on which images are formed by the image forming apparatus.

Such finishers include a punch unit, a stapler, a bookbinding device, and the like. Bookbinding includes stitching an end portion or a center portion of a batch of sheets, attaching an adhesive tape to edges of the sheets, and punching an end portion of the sheets and then binding the sheets using a binder including metal or plastic rings or coils (hereinafter "ring binding").

Several approaches described below have been proposed for such ring binding.

For example, one known technique aims to prevent binding failure caused by thermal expansion or deformation of plastic binders and uses a plastic binder (ring member) including multiple openably closeable rings attached to a bar at given regular intervals. As a hole is formed on each ring in a portion perpendicular to the bar, the binder is allowed to expand or shrink in a longitudinal direction thereof to a given extent. A ring-binding unit for binding sheet using this binder includes a binder holder provided with a registration unit that holds the rings of the binder at a given pitch. As the registration unit can adjust changes in a length of the binder even when the binder expands or shrinks due to changes in temperature, the pitch of the rings can match that of ring holes formed on the sheets, preventing binding failure.

Another known technique provides a sheet transport unit connected to a bookbinding device that binds sheets stacked on its sheet tray or sheets output from an image forming apparatus. The bookbinding device punches the sheets and/or binds the sheets using a ring binder. The sheet transport unit includes a table extending from inside the bookbinding device and a screw conveyor shaft that is provided on a side of the table extending in a longitudinal direction thereof and can engage the ring binders binding sheets. The screw conveyor shaft receives the sheets bound with the ring binder, and the ring binder engages the screw conveyor shaft as the screw conveyor shaft rotates. Then, the screw conveyor shaft transports the sheets bound with the ring binder to an end portion of the table in the longitudinal direction.

Another known method provides a finisher that is connected to an image forming apparatus and includes a punch unit that punches multiple different types of ring holes (punch holes) into the sheets output from the image forming apparatus. This punch unit can accommodate multiple different types of ring binders such as two-hole ring binders, three-hole ring binders, and the like. A control panel of the image forming apparatus includes a ring-hole selection part that displays ring-hole types that the punch unit accommodates. A user can select ring-hole type, and the selected ring-hole type is highlighted or displayed differently from another ring-hole that is not selected.

Different types of coils or ring members whose size and diameter are different are used depending on sheet size, the type of bookbinding, and the like. The number of rings and the intervals therebetween can differ as well depending on sheet size. Therefore, a ring member that is suitable for sheets to be bound together should be selected.

For example, if sheets are bound with a ring member whose size (length) does not match the size of the sheets, appearance of the bound sheets is not good even though the sheets can be bound together as long as intervals between the ring holes on the sheets match intervals between the rings of the ring member. If the size of the ring member is larger than a certain suitable size, the rings will protrude from the bound sheets.

When bookbinding is performed off-line, the user can immediately recognize whether or not the size of the ring member matches sheet size while setting the sheets on the image forming apparatus or the bookbinding device. However, known bookbinding systems are not provided with an input part via which the user can input the type of ring members, and accordingly the user must open the bookbinding device to visually check the type of the ring members set therein. Therefore, when bookbinding is performed online, that is, when printing, bookbinding, and discharging the bound sheets are performed automatically, malfunction might occur due to a discrepancy between the sheet size and the size of the ring member.

The type of ring member and the number of ring holes formed by the punch unit depend on sheet size as described above. Further, a length of a side to be bound (hereinafter "binding side") of the sheets differs depending on sheet size. More specifically, a ring member suitable for a particular sheet size means that the following two conditions are satisfied: The number of the rings of the ring member is identical to a predetermined number of ring holes, and the length of the ring member fits the length of the binding side of the sheets. When these conditions are satisfied, intervals between the rings are identical to intervals between the ring holes formed on the sheets.

The above-described known methods do not disclose processing to be performed when the wrong type of ring member is set in an online bookbinding system, that is, when bookbinding is performed automatically on the sheets transported from the image forming apparatus. Accordingly, there is a need to manage such discrepancies between the type of ring members and sheet size in such an online bookbinding system.

SUMMARY OF THE INVENTION

In view of the foregoing, one illustrative embodiment of the present invention provides a bookbinding system including an image forming apparatus to form an image on a sheet and a bookbinding device to bind together a batch of sheets transported from the image forming apparatus. The bookbinding system includes a punch unit to form a predetermined number of ring holes in a predetermined portion along a side of the sheets to be bound one by one or in a batch, a ring-binding unit disposed downstream from the punch unit in a direction in which the sheet is transported to insert rings of a ring member into the ring holes formed on the batch of sheets by the punch unit, a ring detector disposed at a portion where the ring member is set to detect a type of the ring member, and a determination unit to determine whether or not an ring-binding operation is executable based on a type of the ring member and a size of the sheets to be bound together.

Another illustrative embodiment of the present invention provides a method of binding together a batch of sheets transported from an image forming apparatus automatically. The bookbinding method includes acquiring information on a size of the sheets to be bound together, forming a predetermined number of ring holes in a predetermined portion of the sheets along a side thereof to be bound one by one or in a batch, detecting a type of the ring member set in a bookbinding device, inserting rings of a ring member into the ring holes formed on the batch of sheets, and determining whether or not a ring-binding operation is executable based on the type of the ring member and the size of the sheets.

Yet another illustrative embodiment of the present invention provides a recording medium storing computer-executable program modules to execute the bookbinding method described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
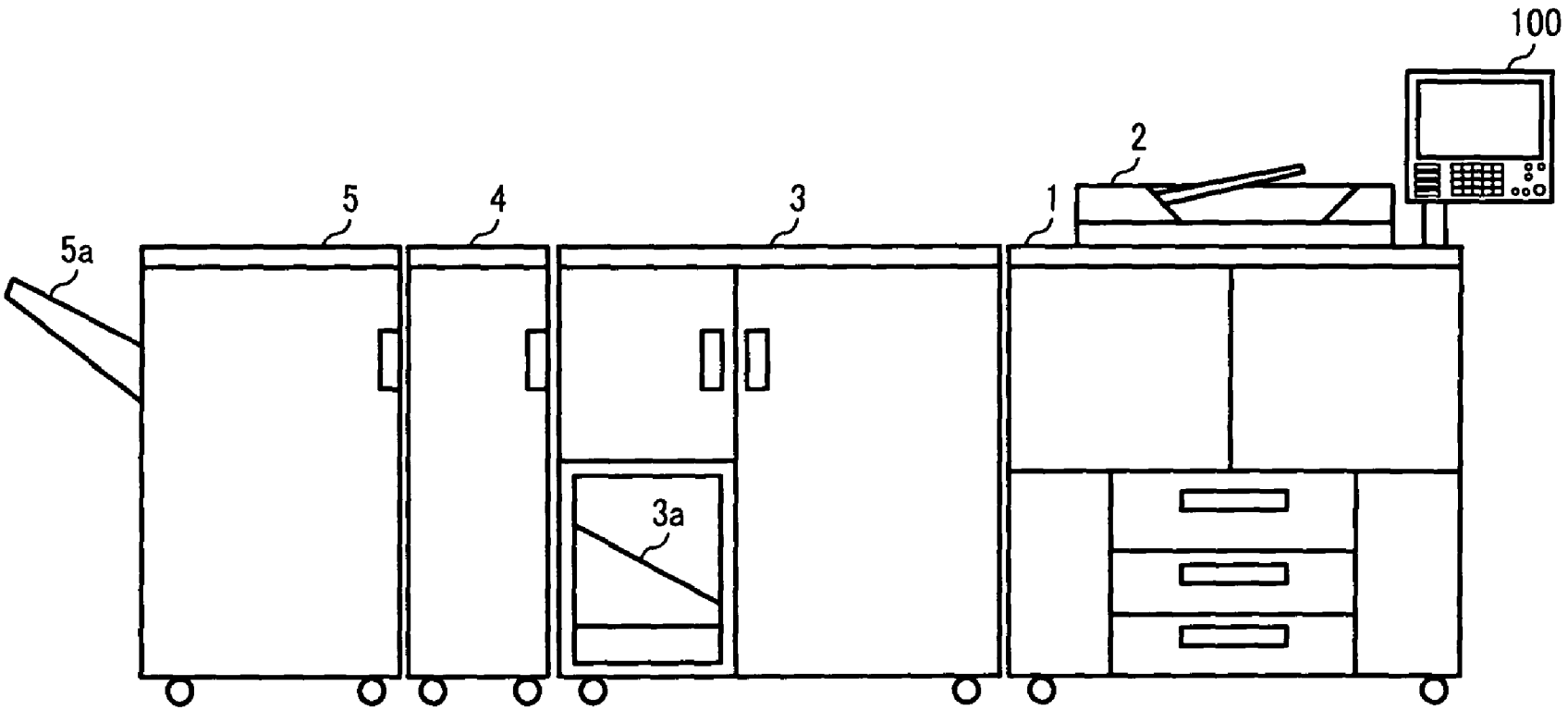
FIG. 1 illustrates a schematic configuration of a bookbinding system including an image forming apparatus and a bookbinding device according to an illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a bookbinding system according to an example embodiment of the present invention is described.

Referring to FIG. 1, the bookbinding system includes an image forming apparatus 1 that in the present embodiment is a multifunction machine (hereinafter "MFP 1"), a bookbinding device 3, a punch device 4, and a finisher 5 arranged in that order in a direction in which sheets of recording media are transported (hereinafter "sheet transport direction").

The MFP 1 is capable of at least two of copying, printing, and facsimile transmission and includes an automatic document feeder (ADF) 2 and a control unit (operation panel) 100 provided with a display serving as an operation display. Although not shown in FIG. 1, the MFP 1 includes an image forming unit, a sheet feeding unit, and an image reading unit or scanner and can form images on sheets stored in the sheet feeding unit according to image information transmitted from a computer or read by the image reading unit.

The user can select or input a size of sheets on which images are to be formed via the control unit 100. Alternatively, the size of the sheets can be automatically selected according to the image information.

The bookbinding device 3 is connected to a downstream side of the MFP 1 in the sheet transport direction. The bookbinding device 3 aligns a batch of sheets transported from the MFP 1, binds the sheets using ring members, and then discharges the bound sheets onto a dedicated tray 3*a* online. The punch device 4 is offline and can punch more than five holes, for example, on a batch of sheets. The finisher 5 includes a discharge tray 5*a*, a puncher capable of forming one through four holes, for example, and a stapler. The finisher 5 can perform post-processing, such as aligning, sorting, stapling, and punching of sheets, through a known method and then discharges the sheets onto the discharge tray 5*a*. When the sheets transported from the MFP 1 are not to be bound together online by the bookbinding device 3, the sheets can be transported to the punch device 4 or the finisher 5.

A configuration and operations of the bookbinding device 3 are described below with reference to FIG. 2, which illustrates the configuration of the bookbinding device 3.

The bookbinding device 3 performs ring binding online. The bookbinding device 3 includes a horizontal transport path 10, aligning trays 13 and 22, a hinged transport unit 30, a downstream transport unit 32, and a stack tray 34 disposed in that order in the sheet transport direction. The bookbinding device 3 further includes a reverse roller 11 and a switch pawl 12 that are disposed on a downstream portion of the horizontal transport path 10 in the sheet transport direction, a punch unit 16 disposed downstream from the aligning tray 13, a punch chad container 21 disposed beneath the punch unit 16, a ring cartridge holder 26 disposed close to the aligning tray 22, and a reflective photosensor 35.

The sheet output from the MFP 1 is transported along the horizontal transport path 10 and then forwarded to the punch device 4 or the finisher 5 when ring binding is not performed. By contrast, when ring binding is to be performed, the sheet is reversed by the reverse roller 11 and then the switch pawl 12 changes a route of the sheet to a punch part including the aligning tray 13, the punch unit 16, a jogger 14 disposed above the aligning tray 13, a transport roller 15, and a stopper 20 disposed downstream from the aligning tray 13. The punch unit 16 includes a die 17, a punch 18, and a cam 19.

When the sheet is placed on the aligning tray 13, the jogger 14 aligns the sheet in a direction perpendicular to the sheet transport direction, which is hereinafter referred to as a transverse direction. The transport roller 15 transports the sheet so that a leading edge portion of the sheet contacts the stopper 20 projecting into the sheet transport path, fixing a position of the sheet in the sheet transport direction. In other words, the position of the sheet in both the transverse direction and the sheet transport direction is fixed by the jogger 14 and the stopper 20. It is to be noted that the sheet is not damaged when contacting the stopper 20 because the transport roller 15 is provided with a torque limiter.

Subsequently, the sheet is punched by the punch unit 16 that punches multiple ring holes (punch holes) for ring binding. When the sheet is positioned by the jogger 14 and the stopper 20, a part of the sheet is on the die 17. In this state, the cam 19 rotates to push the punch 18 down, and thus the sheet is punched between the die 17 and the punch 18.

After the sheet is thus punched, the stopper 20 is released to forward the sheet downstream in the sheet transport direction to an aligning section. Chads generated by punching are held in the punch container 21.

The aligning section includes the aligning tray 22, a transverse jogger 23, a roller 24 that pushes the sheet in the sheet transport direction, and a fence, not shown. The aligning section receives a batch of sheets to be bound together one by one and stacks the sheets on the aligning tray 22 as well as aligns them. While the roller 24 pushes the sheets against the fence, aligning the sheet in the sheet transport direction, the transverse jogger 23 aligns the sheets in the transverse direction.

Then, bookbinding of the sheets is performed in a ring-binding section located downstream from the aligning section. The ring-binding section includes a clamp 25 disposed close to the aligning tray 22, the ring cartridge holder 26, and a hinged ring-binding unit 29.

After a batch of sheets are stacked and aligned on the aligning tray 22, the clamp 25 presses and holds a portion of the sheets close to a portion to be bound. The ring cartridge holder 26 holds a ring cartridge 27 containing multiple ring members 28. In the present embodiment, the ring member 28 is formed with plastic and includes a bar to which multiple rings are attached, and each ring is divided into three portions that are connected so as to be openably closeable. A known ring member can be used as the ring member 28.

The bookbinding device 3 further includes a ring cartridge detector 36 disposed in or close to a portion in which the ring cartridge 27 is set. The ring cartridge detector 36 can identify a type of the ring cartridge 27. Because the ring cartridges 27 contains only a single type of the ring members 28 in the present embodiment, the type (size) of the ring member 28 contained therein can be known by detecting the ring cartridge 27, and thus the ring cartridge detector 36 serves as a ring detector. When the user needs a ring member 28 whose type is different from that of the ring member 28 contained in the ring cartridge 27 set in the bookbinding device 3, the user changes the ring cartridge 27 to another ring cartridge 27.

While the clamp 25 thus holds a batch of sheets, the ring-binding unit 29 swings to a position under the ring cartridge 27 to receive one of the ring members 28, swings back to under the clamp 25 with the ring member 28, and then puts the rings of the ring member 28 into the respective ring holes formed on the sheets. Then, a binding mechanism, not shown, binds the sheet with the ring member 28. The photosensor 35 is disposed close to the aligning tray 22 and detects the size of sheets and the ring holes on the sheets. Detection of sheet size and the ring holes is described below in detail with reference to FIG. 3.

After the sheets are thus bound with the ring member 28 (hereinafter "ring-bound sheets"), the transport unit 30 swings to under the clamp 25. Then, the clamp 25 is released, and thus the ring-bound sheets are placed on the transport unit 30, received by a release pawl 31 provided on a belt of the transport unit 30.

Subsequently, the transport unit 30 swings counterclockwise in FIG. 2 to align with the downstream transport unit 32, and then the release pawl 31 forwards the ring-bound sheets to the downstream transport unit 32 that is provided with a release pawl 33. Then, the release pawl 33 discharges the ring-bound sheets onto the stack tray 34. The stack tray 34 can move up and down as indicated by an arrow in FIG. 2 according to an amount of ring-bound sheets stacked thereon. Thus, a sequence of ring-binding operations is completed.

Figure 3:
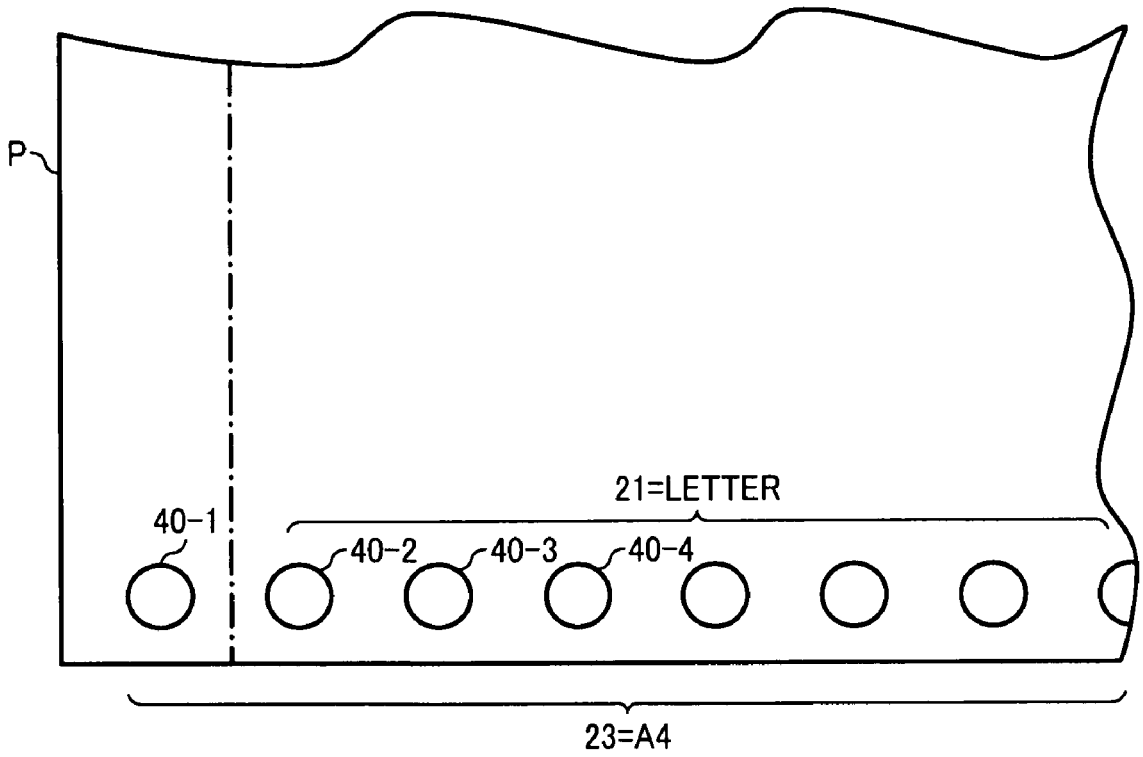
FIG. 3 illustrates an example of ring holes formed on a sheet.

FIG. 3 illustrates ring holes formed on an A4-sized sheet P.

It is to be noted that, in the present embodiment, intervals between the punch holes (hereinafter also "hole pitch") depends on sheet size, and accordingly, intervals between rings of the ring member 28 (hereinafter also "ring pitch") depends on the type of the ring member 28. Therefore, for example, a letter-sized ring member 28 cannot fit punch holes formed by a punch unit for A4 size. However, in the bookbinding device 3, an identical punch unit can be used to punch multiple different sheet sizes. For example, A4-sized sheets and letter-sized sheets can be punched by an identical punch unit so that hole pitch is identical on them, and thus a single type of ring members can be used for both letter-sized sheets and A4-sized sheets.

In FIG. 3, a dotted line indicates an edge of a letter-size sheet in a longitudinal direction. It is to be noted that 23 ring holes, ring holes 40-1 through 40-23, are formed on the A4-sized sheet P in the example shown in FIG. 3 although for simplicity only an end portion of the A4-sized sheet P is illustrated in FIG. 3.

Figure 2:
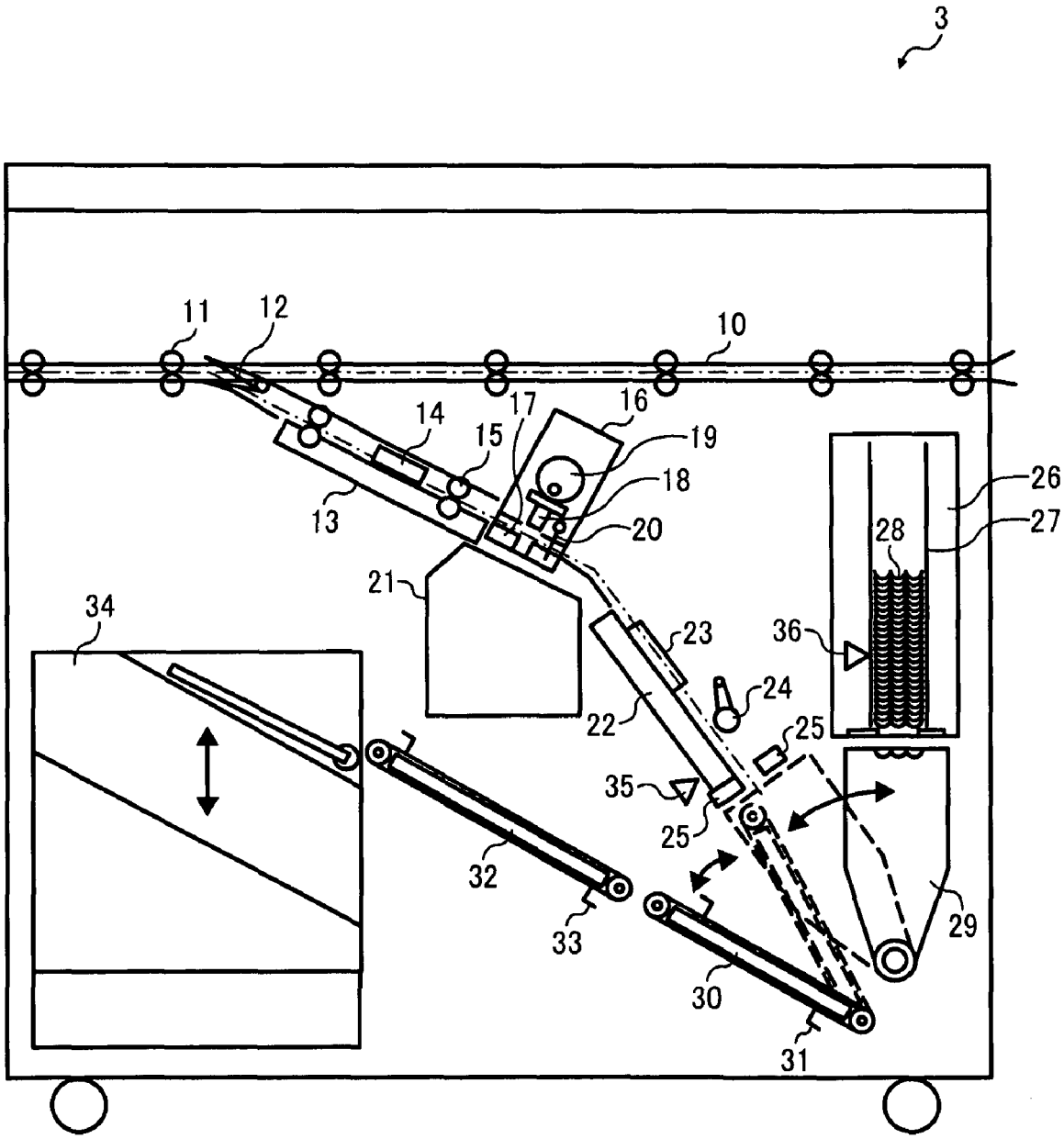
FIG. 2 illustrates a configuration of the bookbinding device shown in FIG. 1.

The photosensor 35 shown in FIG. 2 can distinguish between an A4-sized sheet and a letter-sized sheet and is disposed at a position to detect the outermost ring holes 40-1 and 40-2 on one side of the sheet P in a direction in which the 23 ring holes are arranged. For example, it is assumed that the punch unit 16 is configured to form 23 ring holes on a longitudinal side of the A4-sized sheet. When this punch unit 16 punches the letter-sized sheet, 21 ring holes are formed since a longitudinal side of letter-size sheets is shorter than that of A4-sized sheets by a length corresponding to two ring holes that are most close to both ends in the longitudinal direction. Therefore, in this case, the photosensor 35 is configured to detect two ring holes from one end in the longitudinal direction, that is, the ring holes 40-1 and 40-2.

The sheet P can be identified as an A4-sized sheet when both ring holes 40-1 and 40-2 are detected or as a letter-sized sheet when only the ring hole 40-2 is detected. When reflective photosensor 35 detects neither the ring hole 40-1 nor 40-2, the sheet P can be identified as a B5-sized sheet or an A5-sized sheet.

Alternatively, the photosensor 35 can be configured to also detect ring holes that are formed on a B5-sized sheet but are not formed on an A5-sized sheet so as to distinguish between B5 size and A5 size.

Further, when sheets on which ring holes are preliminarily formed are to be bound together by the bookbinding device 3, a sensor for detecting the ring holes can be provided on a horizontal transport path 10. In the present embodiment, another reflective photosensor is provided close to a position where the sheet stops and is then reversed by the reverse roller 11 although not shown in FIG. 2.

In the present embodiment, a user can input or select the size of sheets to be bound together and the type and/or size of the ring member 28 to be used via the display of the control unit 100.

Figure 4:
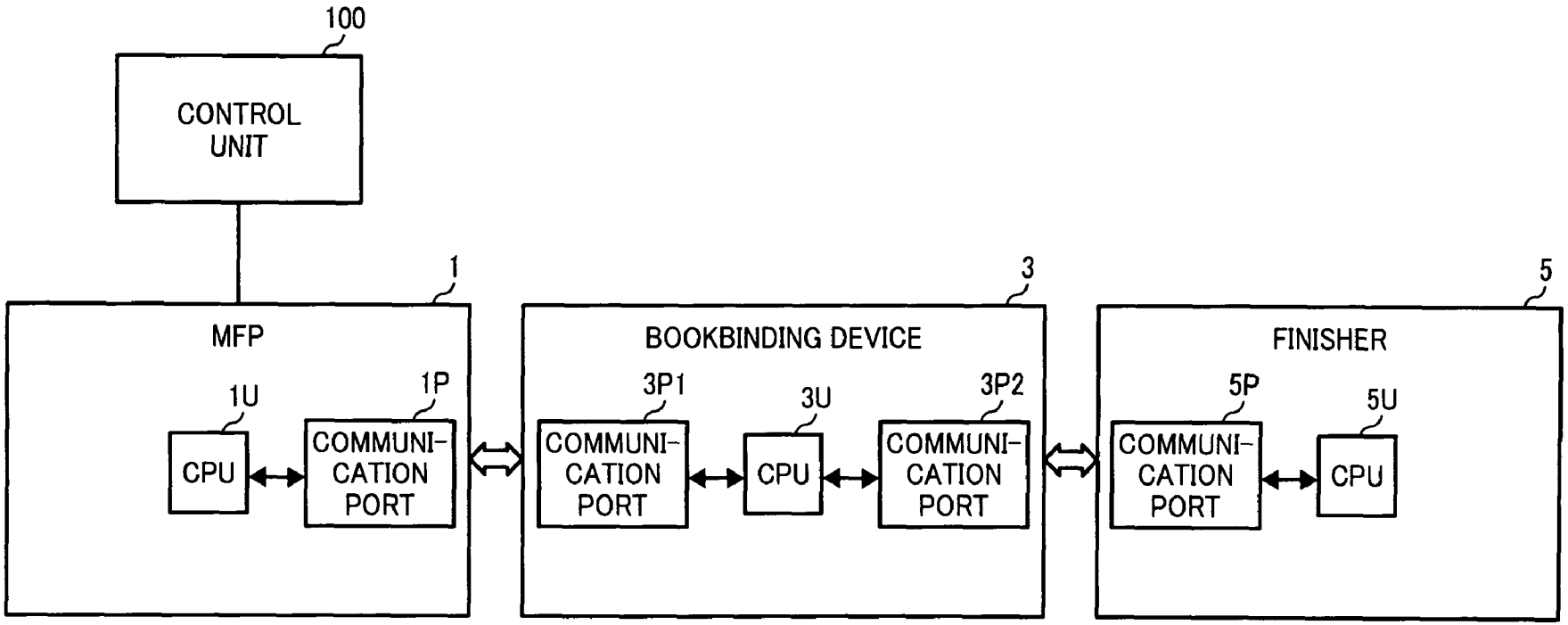
FIG. 4 is a block diagram illustrating an online control system of the bookbinding system shown in FIG. 1.

FIG. 4 is a block diagram illustrating a schematic configuration of an online control system of the bookbinding system shown in FIG. 1.

Referring to FIG. 4, in the online bookbinding system, the bookbinding device 3 is connected to the MFP 1, and the finisher 5 is connected to the bookbinding device 3. The MFP 1 includes a CPU (Central Processing Unit) 1U serving as a determination unit and a communication port 1P. The bookbinding device 3 includes a CPU 3U and communication ports 3P1 and 3P2. The finisher 5 includes a CPU 5P and a communication port 5P. The MFP 1 and the bookbinder device 3 can communicate with each other using the communication ports 1P and 3P1, and the bookbinder device 3 and the finisher 5 can communicate with each other using the communication ports 3P2 and 5P.

In the bookbinding device 3, the CPU 3U can receive detection results generated by both the photosensor 35 and the ring cartridge detector 36 shown in FIG. 2, thus acquiring information on the type of the ring member 28 set therein (hereinafter "ring type information") as well as information on sheet size (hereinafter "sheet size information"). The CPU 3U transmits the ring type information as well as the sheet size information to the CPU 1U.

The control unit 100 is connected to the MFP 1 via an interface (I/F), not shown, and displays various indications described below on the operation panel (display) according to instructions from the CPU 1U of the MFP 1. The user can input instructions to the MFP 1 using the operation panel of the control unit 100.

In each of the MFP 1, the bookbinding device 3, and the finisher 5, the CPU 1U, 3U or 5U reads out program codes from a ROM (Read-Only Memory), runs the program codes in a RAM (Random-Access Memory), and then performs operations according to the program codes using the RAM as a work area to control indications on the control panel and operations described below.

The MFP 1, the bookbinding device 3, and the finisher 5 are connected in series electrically via the communication ports 1P, 3P1, 3P2, and 5P as well as mechanically via at least the horizontal transport path 10 shown in FIG. 2. Thus, when the bookbinding system operates online, the MFP 1, the bookbinding device 3, and the finisher 5 can all be controlled electrically simultaneously.

The relation between the type (size) of the ring member 28 and the size of sheets to be bound by the bookbinding device 3 is described below.

As described above, what the proper size of the ring member 28 is depends on the size of sheets to be bound. The sheets to be bound by the ring member 28 are punched before being bound. More specifically, (1) the number of ring holes depends on sheet size, and (2) the length of the side of the sheets to be bound (hereinafter "binding side") also depends on sheet size. Therefore, a state in which the ring member 28 matches a given sheet size satisfies the following two conditions: (1) The number of the ring holes on the sheets is identical to the number of rings of the ring member 28. (2) The length of the binding side of the sheets is identical or similar to a length in a longitudinal direction of the ring member 28 (hereinafter simply "length of the ring member 28") or a specification of the ring member 28 accommodates the length of the binding side of the sheets. In other words, the length of the ring member 28 fits the sheet size.

Next, a sequence of operations performed in ring-binding processing according to example embodiments is described below.

FIGS. 5 through 10 are flowcharts of the ring-binding processing.

Figure 5:
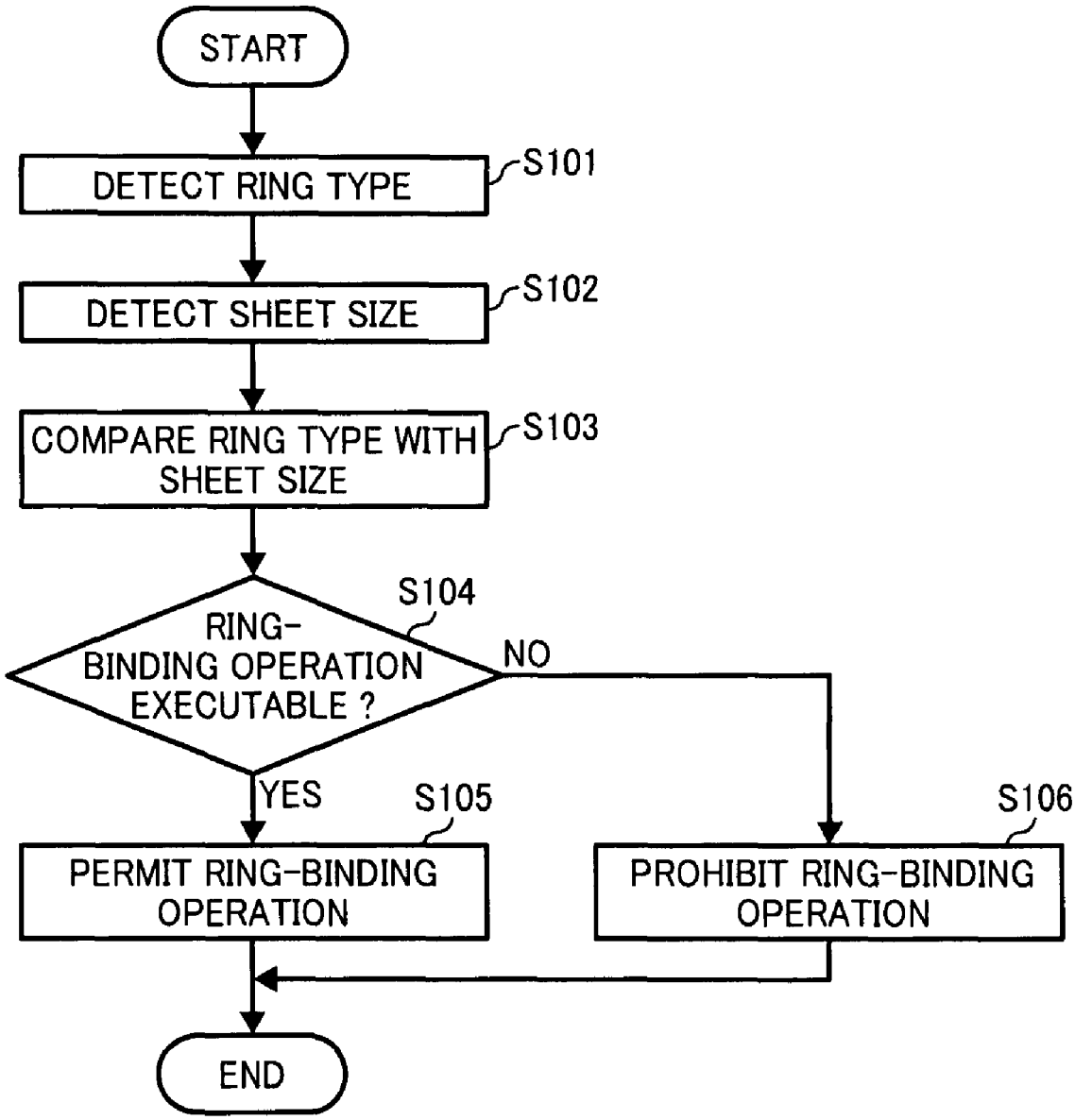
FIG. 5 is a flowchart of ring-binding processing according to an illustrative embodiment of the present invention.

In the ring-binding processing shown in FIG. 5, when the user inputs a print job and selects a ring-binding mode, whether or not ring binding is available is determined before executing the print job.

The user inputs a print job and selects the ring binding mode via the control panel 100 or from a computer. More specifically, the user select or input a print mode, sheet size, the number of copies, the type of the ring member 28, and the like.

Referring to FIGS. 4 and 5, the CPU 1U of the MFP 1 perform the operations shown in FIG. 5 while communicating with the CPU 3U of the bookbinding device 3. The CPU 1U reads out the program codes stored in the ROM of the MFP 1 and then performs the operations shown in FIG. 5 using the RAM as a work area according to the program codes.

At S101, the type of the ring member 28 set in the bookbinding device 3 is detected. More specifically, the CPU 3U acquires the ring type information based on detection results generated by the ring cartridge detector 36 shown in FIG. 2, and then CPU 1U acquires the ring type information from the CPU 3U of the bookbinding device 3. The ring type information includes the number of the rings and the length of the ring member 28. The ring pitch can be known based on the number of ring holes and the length of the ring member 28.

At S102, the sheet size is detected. In this example, the user selects or inputs the sheet size from the control unit 100 (operation panel) that is connected to the MFP 1, and the CPU 1U acquires sheet size information transmitted from the control unit 100.

At S103, the CPU 1U compares the ring type information regarding the ring member 28 acquired at S101 with the sheet size information acquired at S102. At S104 the CPU 1U checks whether or not a ring-binding operation can be performed.

It is to be noted that a ring member 28 that can fit in the ring holes formed by the punch unit 16 is set in the ring cartridge 27 in the present embodiment. More specifically, the ring member 28 set in the ring cartridge has a ring pitch identical to the hole pitch of the sheets regardless of whether or not the length of the ring member 28 fits the sheet size. Thus, a ring member that is not attachable to the sheets is not set in the ring cartridge 27 under normal conditions.

Therefore, only the length of the ring member 28 is necessary as the ring type information, and then the length of the ring member 28 is compared with the sheet size, that is, length of the binding side of the sheets, in the present embodiment.

When the CPU 1U determines that the length of the ring member 28 matches the sheet size and that the ring-binding operation can be performed (YES at S104), at S105 the CPU 1U permits the ring-binding operation. By contrast, when the CPU 1U determines that the ring-binding operation cannot be performed (NO at S104), at S106 the CPU 1U prohibits the ring-binding operation. Then, the process is completed.

As described above, in the embodiment shown in FIG. 5, the relation between the type of ring member 28 and the sheet size is checked, and the ring-binding operation is prohibited when the ring member 28 does not match the sheet size. Therefore, improper ring binding can be prevented.

Figure 6:
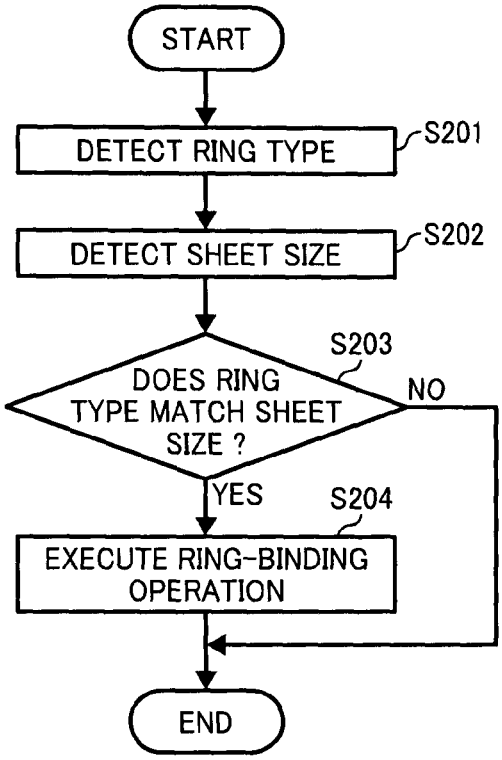
FIG. 6 is a flowchart of ring-binding processing according to another illustrative embodiment.

FIG. 6 is a flowchart of the ring-binding processing according to another embodiment, in which whether or not the ring-binding operation is executable is determined after the sheets to be bound are stacked on the aligning tray 22.

The MFP 1 performs a print job according to instructions from the user. Then, the sheets on which images are formed are transported to the bookbinding device 3, in which the sheets are aligned and stacked one by one on the aligning tray 22 as described above with reference to FIG. 2.

In the ring-binding processing shown in FIG. 6, at S201 the CPU 1U of the MFP 1 detects the type of the ring member 28 by acquiring ring type information transmitted from the CPU 3U of the bookbinding device 3.

At S202, the CPU 1U detects the size of the sheets stacked on the aligning tray 22. The CPU 1U can either acquire sheet size information transmitted from the control unit 100 similarly to the embodiment shown in FIG. 5 or from detection results generated by the photosensor 35. Alternatively, the sheet feeding unit of the MFP 1 can transmit sheet size information to the CPU 1U.

At S203 the CPU 1U checks whether or not the type of the ring member 28 matches the size of the sheet stacked on the aligning tray 22. At S204 the CPU 1U performs the ring-binding operation only when the ring type matches the sheet size (YES at S203).

As described above, in the present embodiment, because the ring-binding operation is performed only when the ring member 28 matches the sheet size, the sheets can be bound properly.

Figure 7:
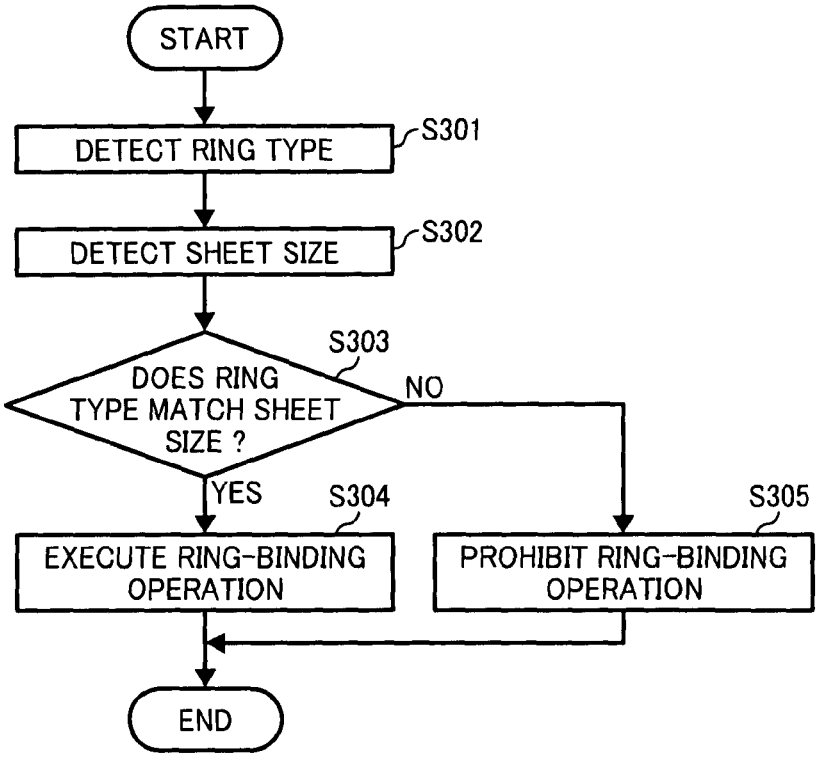
FIG. 7 is a flowchart of ring-binding processing according to another illustrative embodiment.

FIG. 7 is a flowchart of the ring-binding processing according to another embodiment, in which whether or not the ring-binding operation is executable is determined after the sheets are stacked on the aligning tray 22 and then the ring-binding operation is prohibited when the ring member does not match the sheet size.

In the ring-binding processing shown in FIG. 7, operations similar to those performed at S201 through S204 shown in FIG. 6 are performed at S301 through S304.

When the CPU 1U determines that the ring type does not match the sheet size (NO at S303), at S305 the CPU 1U prohibits the ring-binding operation.

As described above, because the ring-binding operation is prohibited when the ring member 28 does not match the sheet size in the present embodiment, appearance of the bound sheets is not disfigured or the ring member 28 does not project from the sheets in a longitudinal direction of the ring member 28.

Figure 8:
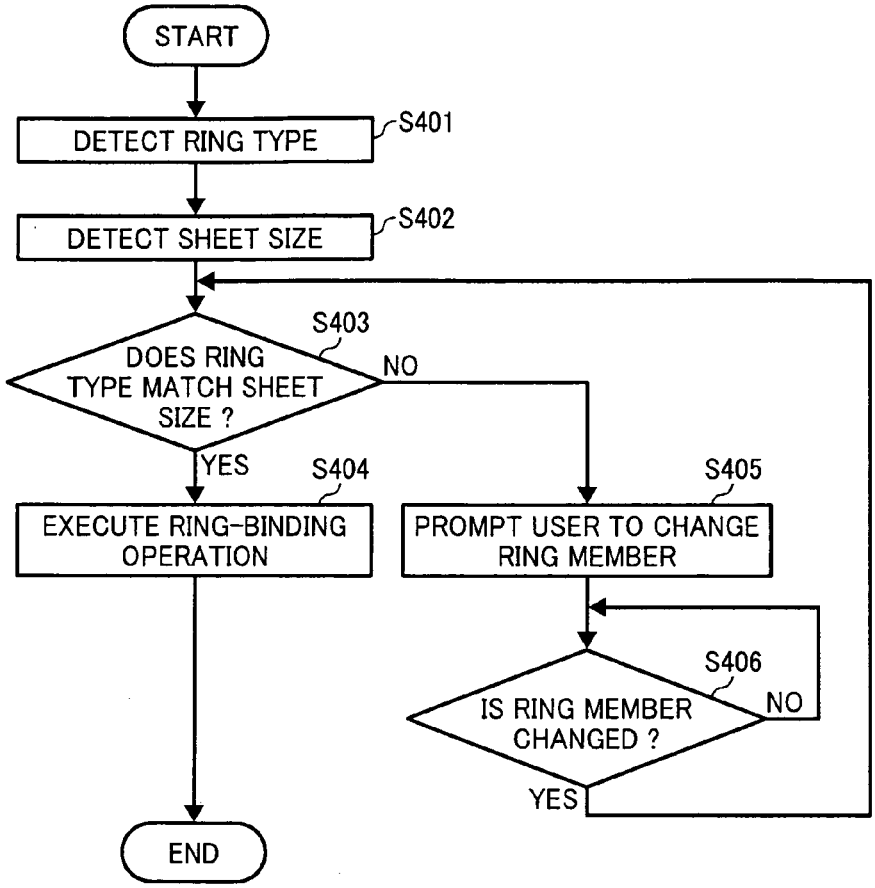
FIG. 8 is a flowchart of ring-binding processing according to another illustrative embodiment.

FIG. 8 is a flowchart of the ring-binding processing according to another embodiment, in which a message to prompt the user to change the ring member 28 appears on the display of the control panel 100 when the ring member does not match the sheet size.

The sheets transported from the MFP 1 to the bookbinding device 3 are aligned and stacked on the aligning tray 22 one by one. In the ring-binding processing shown in FIG. 8, at S401 through S403 the CPU 1U performs operations similar to those performed at S201 through S203 shown in FIG. 6.

When the ring type matches the sheet size (YES at S403), at S304 the CPU 1U causes the ring-biding unit 29 to perform the ring-binding operation. By contrast, when the ring type does not match the sheet size (NO at S403), at S405 the CPU 1U causes the control panel 100 to display the message to prompt the user to change the ring member 28.

Alternatively, the CPU 1U can permit the ring binding operation as long as the ring member 28 is usable for the sheet size even though the ring member 2 does not match that sheet size.

Then, the user changes the ring cartridge 27 to another ring cartridge 27 containing another type of ring members 28. It is to be noted that, when the number of the sheets to be bound together exceeds a capacity of the current ring member 28, not the whole ring cartridge 27 but only the ring members 28 contained therein can be changed to ring members 28 whose capacity is larger.

At S406 the CPU 1U checks whether or not the ring member 28 is changed to another ring member (newly set ring member) 28. When the ring member 28 is changed (YES at S406), the process returns to S403 to check whether or not the newly set ring member 28 matches or is usable for that sheet size. When the ring type of the newly set ring member 28 matches the sheet size (YES at S403), at S304 the ring-binding operation is performed.

It is to be noted that the report of disagreement between the ring type and the sheet size to the user is not limited to the message on the control panel 100. For example, disagreement between the ring type and the sheet size can be reported using at least one of the message on the control panel 100, buzzer, and a warning indicator such as a light or lamp.

Because the ring-binding operation is not performed until the ring member 28 is not changed to another ring member 28 that matches or is usable for the sheet size in the present embodiment, improper bookbinding can be prevented.

Figure 9:
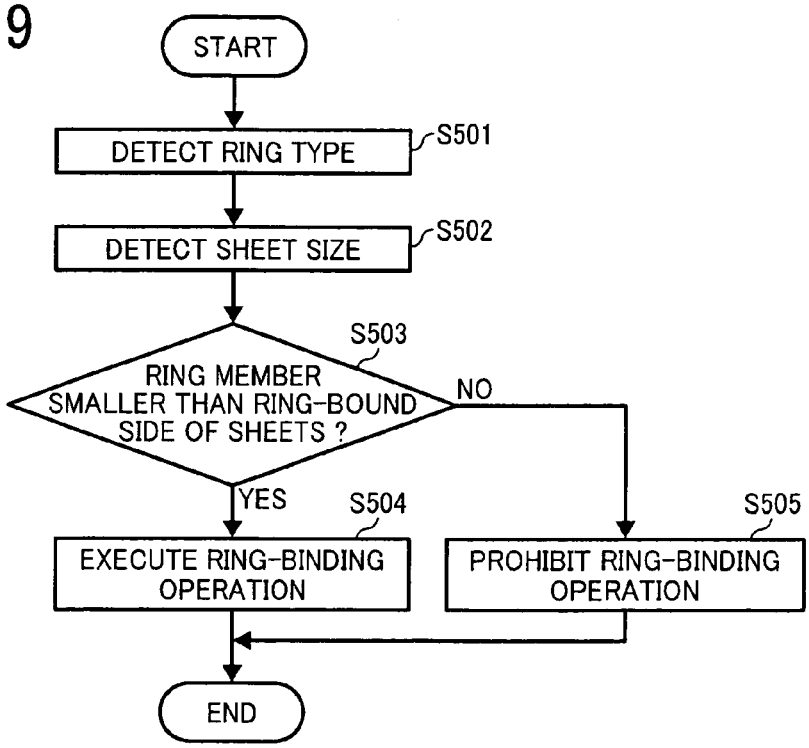
FIG. 9 is a flowchart of ring-binding processing according to another illustrative embodiment.

FIG. 9 is a flowchart of the ring-binding processing according to another embodiment.

In the ring-binding processing shown in FIG. 9, the ring-binding operation is permitted when the ring member 28 is usable for a given sheet size even though the ring member 28 does not match that sheet size. More specifically, the ring member 28 is usable as long as the ring pitch is identical or similar to the hole pitch and the ring member 28 is shorter than the binding side of the sheet size or the number of ring holes is not less than that of rings of the ring member 28.

The sheets transported from the MFP 1 to the bookbinding device 3 are aligned and stacked on the aligning tray 22 one by one. In the ring-binding processing shown in FIG. 9, at S501 and S502 the CPU 1U performs operations similar to those performed at S201 and S202 shown in FIG. 6.

It is to be noted that a ring member 28 whose ring pitch is identical or similar to the hole pitch is set in the ring cartridge 27 as described above.

At S503, the CPU 1U compares the type of the ring member 28 and the size of the sheet on the aligning tray 22. More specifically, the CPU 1U compares the length of the ring member 28 with the length of binding side of the sheets. When the length of the ring member 28 is not greater than that of the binding side of the sheets (YES at S503), at S504 the CPU 1U deems the ring member 28 usable and causes the ring-biding unit 29 to perform the ring-binding operation.

By contrast, when the length of the ring member 28 is greater than that of the binding side of the sheets (NO at S503), at S505 the CPU 1U deems the ring member 28 unusable and prohibits the ring-binding operation.

The length of the ring member 28 and that of the binding side of the sheets are compared in further detail below with reference to FIG. 3.

In the embodiments shown in FIG. 6 through 8, the CPU 1U does not perform the ring-binding operations when the ring member 28 does not match the sheet size. For example, the CPU 1U determines that a ring member for letter size (hereinafter "letter-size ring member") does not match A4-sized sheets. As described above, 23 ring holes are formed on A4 size while 21 holes are formed on letter size in the example shown in FIG. 3. In other words, the binding side of letter size is shorter than that of A4 size by a length corresponding to one ring hole on each side.

However, in the present embodiment shown in FIG. 9, the CPU 1U determines that the ring-binding operation is executable when the length of the ring member 28 is not greater than that of the binding side of the sheets as described above.

Referring to FIG. 3, it is assumed that letter size and A4 size are punched by an identical punch unit 16. In this case, even though the rings of a letter-sized ring member are not inserted into two ring holes on A4 size, the ring hole 40-1 on one end and the ring hole 40-23 on another end, not shown, the A4-sized sheets can be bound with the letter-size ring member because the rings can be inserted into the ring holes 40-1 through 40-22. Additionally, because the ring member does not project from the sheets in a longitudinal direction, neither appearance nor usability of the A4-sized sheets bound with the letter-size ring member is impaired.

It is to be noted that the size of the sheets stacked on the aligning tray 22 can be detected by providing a sensor such as the photosensor 35 as described above.

As described above, the ring-binding operation is executed when the binding side of the sheets is longer than the ring member 28 in the present embodiment, a common ring member can be used for multiple different sheet sizes that in the present embodiment are letter size and A4 size without disfiguring both appearance and usability of the bound sheets.

It is to be noted that, in the ring-binding processing shown in FIGS. 6 through 9, the ring-binding operation is performed after the number of sheets stacked on the aligning tray 22 has reached a number set by the user, that is, all the sheets to be bound together have stacked on the aligning tray 22.

Figure 10:
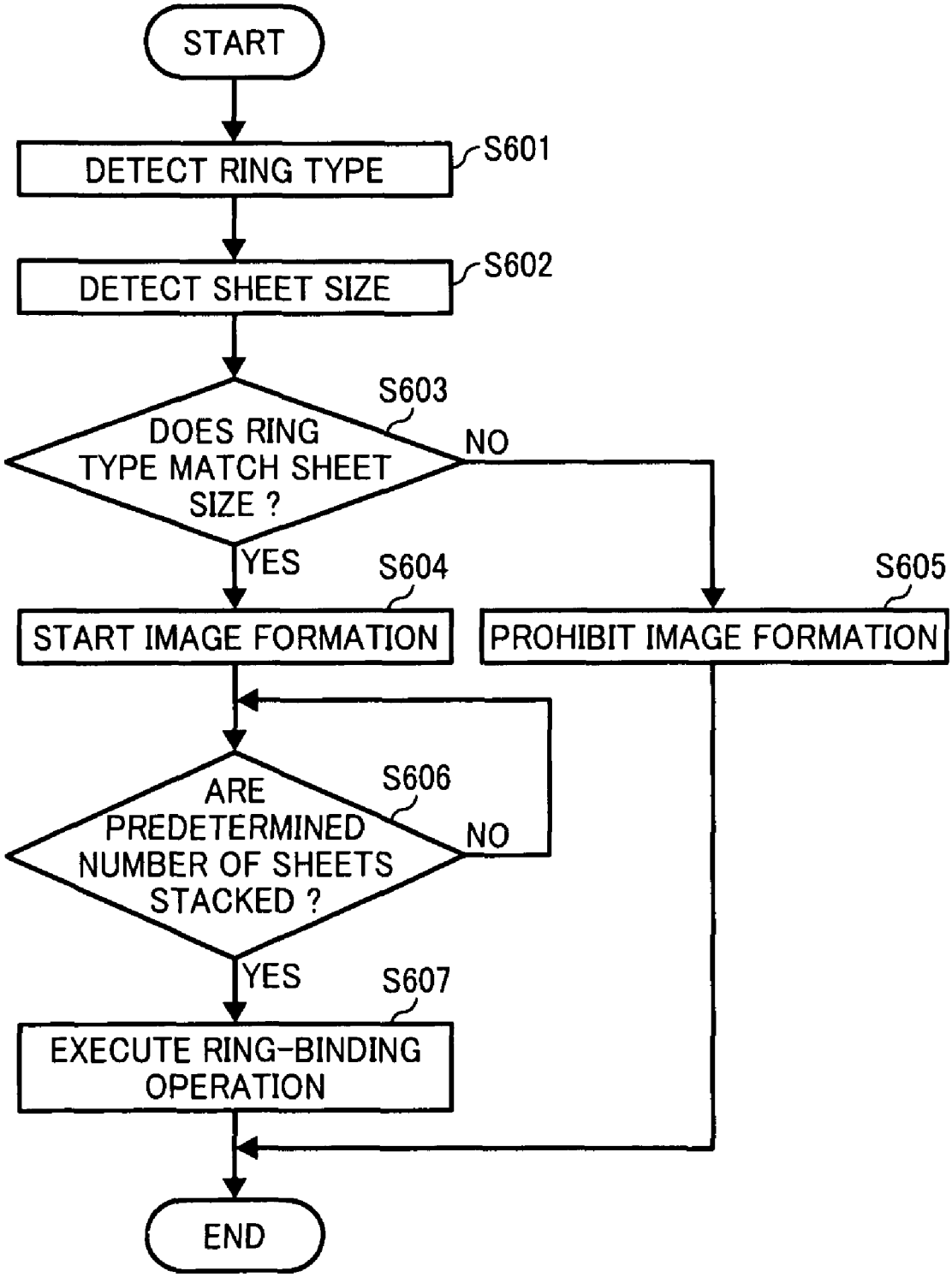
FIG. 10 is a flowchart of ring-binding processing according to another illustrative embodiment.

FIG. 10 is a flowchart of the ring-binding processing according to another embodiment.

In the ring-binding processing shown in FIG. 10, when the user selects the ring-binding mode, the CPU 1U checks the relation between sheet size and type of the ring member 28 and prohibits image formation when sheet size does not match the type of the ring member 28.

The user inputs a print job and selects the ring binding mode via the control panel 100 or a computer.

In the ring-binding processing shown in FIG. 10, at S601 through S603 the CPU 1U performs operations similar to those performed at S101 through S103 shown in FIG. 5.

When the ring type matches the sheet size (YES at S603), at S604 the CPU 1U causes the image forming unit to start image formation and at S606 checks whether or not the number of the sheets stacked on the aligning tray 22 has reached a predetermined or given number that can be a number set by the user or all sheets in one copy has stacked on the aligning tray 22. When the number of the sheets stacked on the aligning tray 22 has reached the number set by the user (YES at S606), at S607 the CPU 1U causes the ring-binding unit 29 to perform the ring-binding operation.

By contrast, when the ring type does not match the sheet size (NO at S603), the CPU 1U prohibits image formation and terminates the process.

As described above, in the ring-binding processing shown in FIG. 10, because image formation is prohibited when the type (size) of the ring member 28 does not match the length of the binding side of the sheets, unwanted image formation as well as improper ring binding can be prevented.

It is to be noted that the program codes to execute the various ring-binding processing described above are can be stored in a computer-readable recording medium as a computer-executable program.

In addition, numerous additional modifications and variations are possible in light of the above teachings. It is therefore to be understood that, within the scope of the appended claims, the disclosure of this patent specification may be practiced otherwise than as specifically described herein.

What is claimed is:

1. A bookbinding system including an image forming apparatus to form an image on a sheet and a bookbinding device to bind together a batch of sheets transported from the image forming apparatus, the bookbinding system comprising:

a punch unit to form a predetermined number of ring holes in a predetermined portion along a side of the sheets one by one or in a batch;

a ring-binding unit disposed downstream from the punch unit in a direction in which the sheet is transported to insert rings of a ring member into the ring holes formed on the batch of sheets by the punch unit, the ring member having a ring pitch equal to an interval between the rings, and the sheets having a hole pitch equal to an interval between the ring holes;

a ring detector disposed at a portion where the ring member is set to detect a type of the ring member set in the bookbinding device; and a determination unit to determine whether or not a ring-binding operation is executable based on the type of the ring member and a size of the sheets to be bound together, wherein the size of the sheets is a length of the side of the sheets to be bound by the ring-binding unit, wherein the determination unit determines that the ring-binding operation is not executable, only if a length of the ring member is greater than the length of the side of the sheets to be bound, or the ring pitch equals the hole pitch and a number of the rings is greater than the number of ring holes.

2. The bookbinding system according to claim 1, wherein the punch unit and the bookbinding unit are provided in the bookbinding device, and the determination unit is provided in the image forming apparatus.

3. The bookbinding system according to claim 1, wherein the determination unit determines that the ring member matches the size of the sheets if an interval between the rings of the ring member is identical to an interval between the ring holes, a number of the rings of the ring member is identical to the number of the ring holes, and a length of the ring member fits the length of the side of the sheets to be bound.

4. The bookbinding system according to claim 3, wherein the determination unit causes the ring-binding unit to execute the ring-binding operation when the ring member matches the size of the sheets.

5. The bookbinding system according to claim 3, wherein, when the ring member does not match the size of the sheets, the determination unit determines that the ring-binding operation is not executable and prohibits the ring-binding operation.

6. The bookbinding system according to claim 3, wherein the determination unit prompts a user to change the ring member when the ring member does not match the size of the sheets and the ring-binding operation is not executable.

7. The bookbinding system according to claim 6, further comprising an operation display provided on the image forming apparatus, wherein the determination unit prompts the user to change the ring member via the operation display of the image forming apparatus.

8. The bookbinding system according to claim 6, wherein, after the ring member is changed to another ring member that matches the size of the sheets, the determination unit determines that the ring-binding operations is executable and causes the ring-binding unit to execute the ring-binding operation.

9. The bookbinding system according to claim 3, wherein the determination unit prohibits image formation when the ring member does not match a size of sheets on which image are to be formed and that are to be bound together.

10. The bookbinding system according to claim 1, wherein the determination unit determines that the ring member is usable when an interval between the rings of the ring member is identical to an interval between the ring holes and a length of the ring member is not greater shorter than the length of the side of the sheets to be bound.

11. The bookbinding system according to claim 1, wherein the image forming apparatus comprises an input unit via which a user inputs the size of the sheets.

12. The bookbinding system according to claim 1, further comprising a ring hole detector to detect two outermost ring holes formed on the side of the sheets, wherein the determination unit deems the size of the sheets A4 size in response to the ring hole detector detecting the two outermost ring holes, letter size in response to the ring hole detector detecting only one of the two outermost ring holes, and smaller than letter size in response to the ring hole detector detecting neither of the two outermost ring holes.

13. The bookbinding system according to claim 1, wherein the determination unit determines that the ring-binding operation is not executable, if the length of the ring member is greater than the length of the side of the sheets to be bound and the number of rings of the ring member is greater than the number of ring holes.

14. A method of binding together a batch of sheets transported from an image forming apparatus automatically, the bookbinding method comprising:

acquiring information on a size of the sheets to be bound together;

forming a predetermined number of ring holes in a predetermined portion along a side of the sheets one by one or in a batch;

detecting a type of a ring member set in a bookbinding device, the ring member having a number of rings and a ring pitch equal to an interval between the rings, and the sheets having a hole pitch equal to an interval between the ring holes;

determining whether or not a ring-binding operation is executable based on the type of the ring member and the size of the sheets, wherein the size of the sheets is a length of the side of the sheets to be bound by the ring-binding operation, the ring-binding operation not being executable, only if a length of the ring member is greater than the length of the side of the sheets to be bound, or the ring pitch equals the hole pitch and the number of the rings is greater than the number of ring holes; and inserting rings of the ring member into the ring holes formed on the batch of sheets if the ring-binding operating is executable.

15. The bookbinding method according to claim 14, wherein the sheet size is determined to match the ring member when an interval between the rings of the ring member is identical to an interval between the ring holes, the number of the rings of the ring member is identical to that of the ring holes, and the length of the ring member fits that of the side of the sheets to be bound.

16. The bookbinding method according to claim 15, wherein the ring-binding operation is determined to be executable when either the ring member matches the size of the sheets, the ring member is changed to another ring member that matches the size of the sheets, or an interval between the rings of the ring member is identical to an interval between the ring holes and a length of the ring member is not greater than a length of the side of the sheets to be bound.

17. The bookbinding method according to claim 15, wherein the ring-binding operation is determined to be inexecutable when the ring member does not match the size of the sheets.

18. The bookbinding method according to claim 17, further comprising prohibiting image formation when the ring member does not match the size of the sheets.

19. A non-transitory recording medium storing computer-executable program modules to execute a method of binding together a batch of sheets transported from an image forming apparatus automatically, the bookbinding method comprising:

acquiring information on a size of the sheets to be bound together;

forming a predetermined number of ring holes in a predetermined portion along a side of the sheets one by one or in a batch;

detecting a type of a ring member set in a bookbinding device, the ring member having a number of rings and a ring pitch equal to an interval between the rings, and the sheets having a hole pitch equal to an interval between the ring holes;

inserting rings of the ring member into the ring holes formed on the batch of sheets; and determining whether or not a ring-binding operation is executable based on the type of the ring member and the size of the sheets, wherein the size of the sheets is a length of the side of the sheets to be bound by the ring-binding operation, the ring-binding operation not being executable, only if a length of the ring member is greater than the length of the side of the sheets to be bound, or the ring pitch equals the hole pitch and the number of the rings is greater than the number of ring holes.

* * * * *